US006929228B2

(12) United States Patent
Whitaker et al.

(10) Patent No.: US 6,929,228 B2
(45) Date of Patent: Aug. 16, 2005

(54) ADJUSTABLE KEYBOARD SUPPORT

(75) Inventors: Russell Whitaker, Kentwood, MI (US); Scott A. Williamson, Caledonia, MI (US); Peter M. Barber, Fergus (CA); James L. LeClair, Drumbo (CA); Philip Roodvoets, Middleville, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/606,139

(22) Filed: Jun. 25, 2003

(65) Prior Publication Data

US 2004/0262477 A1 Dec. 30, 2004

(51) Int. Cl.[7] ..... A47B 57/00; E04G 3/00

(52) U.S. Cl. ..... 248/284.1; 248/918

(58) Field of Search ..... 248/918, 284.1, 248/286.1, 278.1, 279.1, 280.11, 281.11

(56) References Cited

U.S. PATENT DOCUMENTS

| | | | | | |
|---|---|---|---|---|---|
| 3,995,797 | A | * | 12/1976 | Knight | 248/184.1 |
| 4,567,835 | A | * | 2/1986 | Reese et al. | 108/7 |
| 5,145,136 | A | * | 9/1992 | McConnell | 248/284.1 |
| 5,374,022 | A | * | 12/1994 | Gilmer et al. | 248/396 |
| 5,901,933 | A | * | 5/1999 | Lin | 248/285.1 |
| 5,924,664 | A | | 7/1999 | Mileos et al. | 248/281.11 |
| 5,924,666 | A | | 7/1999 | Liu | 248/286.1 |
| 6,012,693 | A | * | 1/2000 | Voeller et al. | 248/280.11 |
| 6,135,404 | A | | 10/2000 | Wisniewski et al. | 248/281.11 |
| 6,176,456 | B1 | | 1/2001 | Wisniewski | 248/281.11 |
| 6,186,460 | B1 | | 2/2001 | Lin | 248/284.1 |
| 6,199,809 | B1 | | 3/2001 | Hung | 248/284.1 |
| 6,257,538 | B1 | * | 7/2001 | Pangborn et al. | 248/284.1 |
| 6,270,047 | B1 | | 8/2001 | Hudson | 248/286.1 |
| 6,322,031 | B1 | * | 11/2001 | LeClair et al. | 248/286.1 |
| 6,397,763 | B1 | | 6/2002 | Panzarella et al. | 108/138 |
| 6,409,127 | B1 | * | 6/2002 | VanderHeide et al. | 248/118 |
| 6,450,467 | B2 | * | 9/2002 | Timm | 248/284.1 |
| 6,488,248 | B1 | | 12/2002 | Watt et al. | 248/279.1 |
| 6,533,229 | B1 | | 3/2003 | Hung | 248/286.1 |
| 6,726,168 | B2 | * | 4/2004 | Barber | 248/284.1 |

* cited by examiner

*Primary Examiner*—Jonathon Szumny
(74) *Attorney, Agent, or Firm*—Price, Heneveld, Cooper, DeWitt & Litton, LLP

(57) ABSTRACT

An adjustable keyboard support mechanism includes a mounting bracket for attachment to a support surface, a platform for supporting a keyboard thereon, a support arm operably connected to the mounting bracket and the platform, and a locking mechanism for restricting height adjustment of the platform with respect to the support surface. The locking mechanism includes a center arm pivotable with respect to the platform and slidable with respect to the mounting bracket, a plurality of frictional members sandwiching and frictionally engaging the center arm, thereby restricting the sliding movement of the center arm with respect to the mounting bracket, and a wedge assembly actuable by pivoting movement of the platform and engageable with the frictional members to both restrict and allow height adjustment of the platform relative to the support surface. The adjustable keyboard support further includes a tilt adjustment mechanism having an actuator member defining a length and operably coupled to a first portion of the platform and linking member operably coupled to a second section of the platform and adjustable along the length of the actuator such that an adjustment of the linking member along the length of the actuator member causes the second section of the platform to pivot with respect to the first section, thereby adjusting a tilt of the second section of the platform relative to the support surface.

17 Claims, 3 Drawing Sheets

ADJUSTABLE KEYBOARD SUPPORT

BACKGROUND OF THE INVENTION

This invention relates generally to adjustable supports, and in particular to an articulating platform or support for a data input device, such as a computer keyboard, mouse, or the like.

Personal computers are becoming more and more common in many industries and office environments, and such systems typically employ a keyboard, key pad, mouse, and/or other date input devices, such as a digitizing pad. Often, the personal computer occupies much of the desk or worksurface making it difficult to locate the keyboard thereon. Furthermore, many users do not prefer to locate the keyboard on the desktop because it is uncomfortable to address the keyboard over the course of the workday.

A number of devices have been developed to offer greater flexibility in supporting the keyboard, mouse, or other device at a comfortable position relative to the user. Many of these systems are structurally complex and typically require rather awkward adjustments through manipulations of a number of knobs, levers, and/or handles. Moreover, many of the adjustable keyboard supports available today utilize an adjustment system which is counter-intuitive, insofar as the end user must learn a detailed sequence of steps, knobs, controls, locks, etc., before the device can be used effectively instead of simply moving the keyboard directly to the desired position.

SUMMARY OF THE INVENTION

One aspect of the present invention is to provide an adjustable keyboard support mechanism that includes a mounting bracket adapted for attachment to a support surface, a platform having a forward portion and a rearward portion thereof disposed generally opposite the forward portion, and a support arm having a first end thereof pivotally coupled with the mounting bracket at a first point and slidably coupled with the mounting bracket at a second point, and a second end pivotally coupled with the platform at a third point. The adjustment keyboard support mechanism also includes a locking mechanism including a center arm having a first end slidably coupled to the mounting bracket at the second point, and pivotally coupled with the platform at the third point, such that an upwardly directed force exerted on the front side of the platform allows the center arm to slide with respect to the second point. The locking mechanism also includes at least two planar frictional members sandwiching and frictionally engaging the center arm, such that the sliding movement of the center arm with respect to the second point is restricted, and a wedge member having an angled surface, and an abutment surface opposite the angle surface of the wedge member and adapted to abut one of the frictional members. The locking member further includes a wedge arm having a first end pivotally coupled to the platform at a fourth point, and a second end slidably coupled to the mounting bracket at the second point such that the upwardly-directed force exerted on the front edge of the platform causes the wedge arm to slide with respect to the second point. The second end of the wedge arm includes an angled surface adapted to abut the angled surface of the wedge arm such that sliding of the wedge arm due to the upwardly-directed force exerted on the platform reduces a force exerted on the wedge member by the wedge arm and reduces the frictional engagement between the frictional member and the center arm, thereby allowing the center arm to slide with respect to the second point and the height of the platform to be adjusted relative to the support surface.

Another aspect of the present invention is to provide an adjustable keyboard support mechanism that includes a mounting bracket adapted for attachment to a support surface, and a support arm having a first end thereof operably coupled with the mounting bracket, and a second end. The adjustable keyboard support mechanism also includes a platform having a first section having a forward portion and rearward portion disposed generally opposite the forward portion and operably coupled to the second end of the support arm, and a second section having a forward portion and a rearward portion disposed generally opposite the forward portion of the second section and pivotally coupled to the forward portion of the first section at a first point. The keyboard support mechanism further includes an adjustment mechanism having an actuator member defining a length and operably coupled with the first section of the platform, and a linking member operably coupled to the rearward portion of the second section of the platform at a second point and adjustable along the length of the actuator member such that an adjustment of the linking member along the length of the actuator member causes the platform to pivot about the first point, thereby adjusting a tilt of the second section of the platform relative to the support surface.

Yet another aspect of the present invention is to provide an adjustable keyboard support mechanism that includes a mounting bracket adapted for attachment to a support surface, and a platform having a first section having a forward portion and a rearward portion disposed generally opposite the forward portion, and second section having a forward portion and a rearward portion disposed generally opposite the forward portion of the second section and pivotally coupled to the forward portion of the second section at a first point. The keyboard support mechanism also includes a support arm having a first end thereof pivotally coupled with the mounting bracket at a second point and slidably coupled with the mounting bracket at a third point, and a second pivotally coupled with the platform at a fourth point. The keyboard support mechanism further includes a locking mechanism including a center arm having a first end slidably coupled to the mounting bracket at the third point, and a pivotally coupled with the platform at the fourth point, such that an upwardly directed force exerted on the platform causes the center arm to slide with respect to the third point, and at least two planar frictional members sandwiching and frictionally engaging the center arm, such that the sliding movement of the center arm with respect to the third point is restricted. The locking mechanism also includes a wedge member having an angled surface, and an abutment surface opposite the angled surface of the wedge member and adapted to abut one of the frictional members. The locking mechanism further includes a wedge arm having a first end pivotally coupled to the platform at a fifth point, and a second end slidably coupled to the mounting bracket at the third point such that the upwardly-directed force exerted on the platform causes the wedge arm to slide with respect to the third point. The second end of the wedge arm has an angled surface adapted to abut the angled surface of the wedge member such that sliding of the wedge arm due to the upwardly-directed force exerted on the platform reduces a force exerted on the wedge member by the wedge arm and reduces the frictional engagement between the frictional member and the center arm, thereby allowing the center arm to slide with respect to the third point and the height of the platform to be adjusted relative to the support surface. The keyboard support mechanism further includes a tilt adjustment mechanism having an actuator member defining a length and operably coupled with the first section of the platform, and a linking member operably coupled to the rearward portion of the second section of the platform at a sixth point and adjustable along the length of the actuator member such that an adjustment of the linking member along the length of the actuator member causes the second section of the platform to pivot about the first point, thereby adjusting a tilt of the second section of the platform relative to the support surface.

The present inventive adjustable keyboard support mechanism provides an uncomplicated design, can be easily and quickly adjusted by the end user is efficient in its use, economical to manufacture, capable of a long operating life, and is particularly well adapted for the proposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
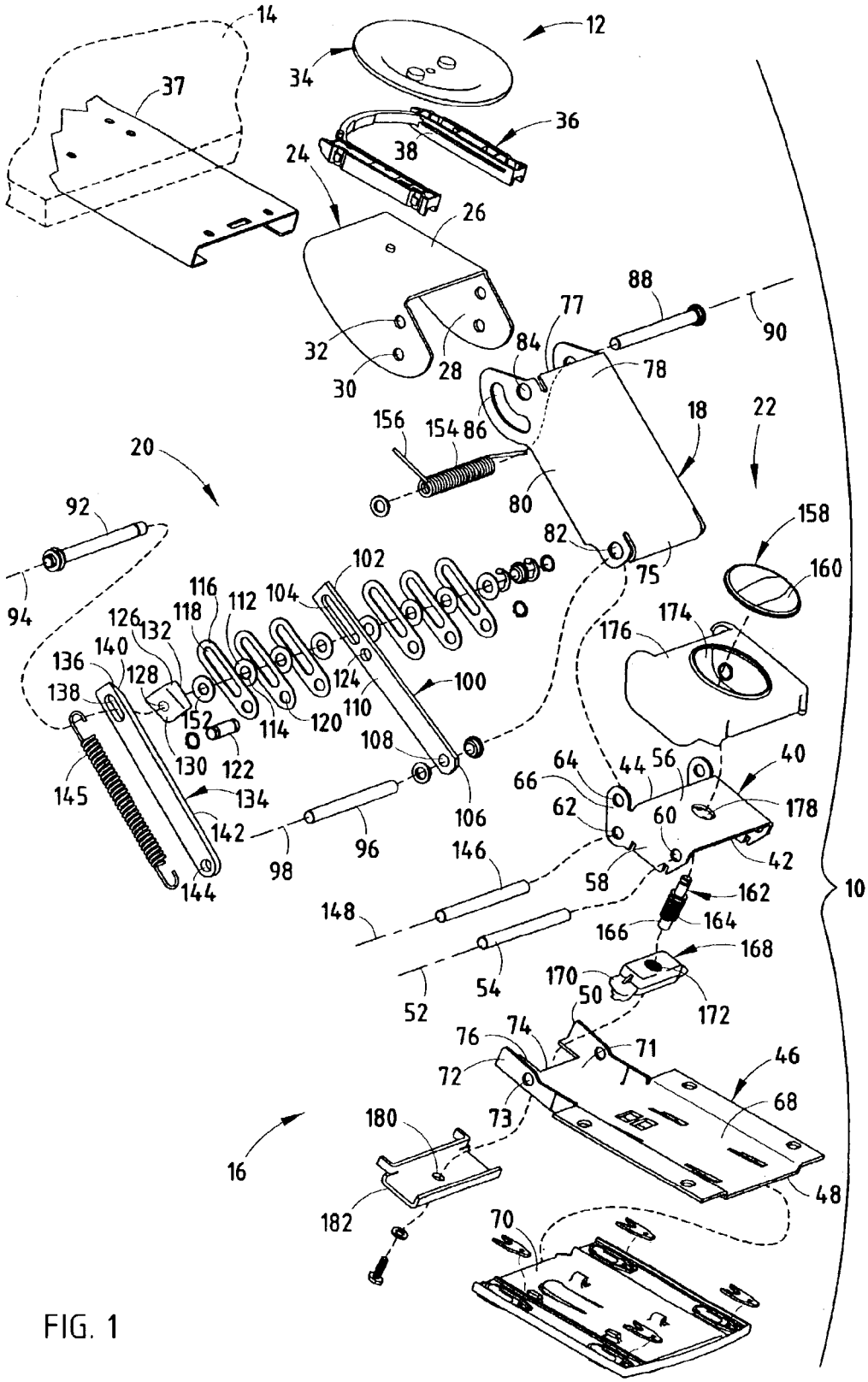
FIG. 1 is an exploded, top perspective view of an adjustable keyboard support embodying the present invention.
Figure 2:
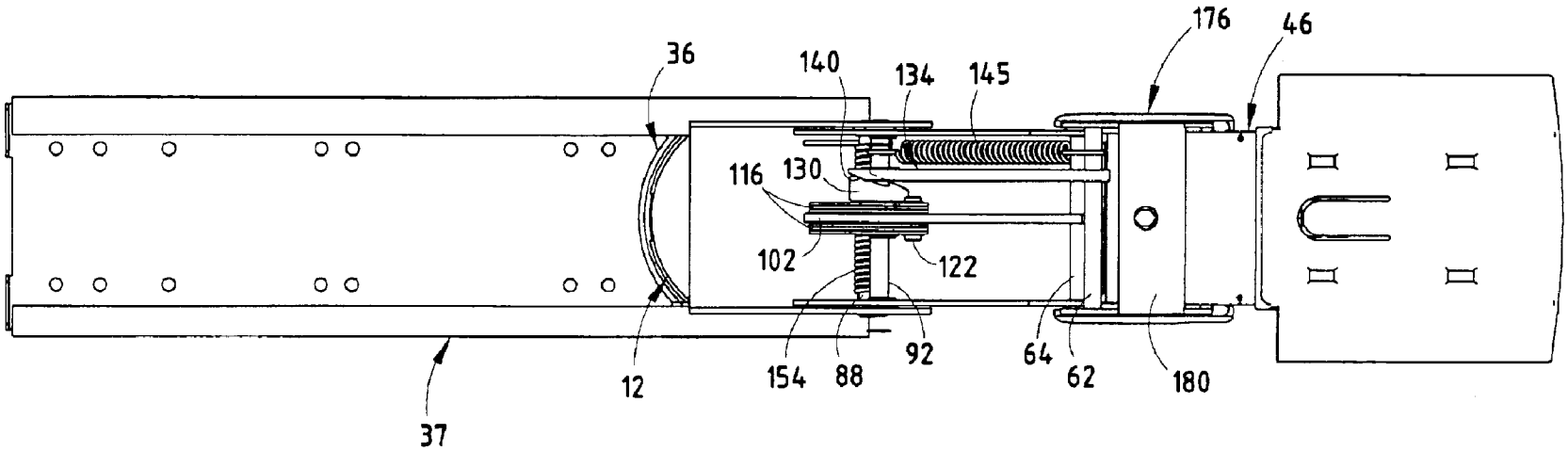
FIG. 2 is a top bottom plan view of the keyboard support.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 10 (FIG. 1) generally designates a keyboard support mechanism embodying the present invention. In the illustrated example, the keyboard support mechanism 10 includes numerous components including a mounting bracket assembly 12 adapted to attachment to a support surface 14, a platform assembly 16 adapted to support a keyboard (not shown), mousing pad, or the like, thereon, and a support arm 18 operably coupling the mounting bracket assembly 12 and the platform assembly 16. The keyboard support mechanism 10 also includes a locking mechanism 20 adapted to fixably retain the platform assembly 16 at a given height with respect to the support surface 14, and a tilt adjustment mechanism 22 adapted to retain the platform assembly 16 at a particular angular attitude with respect to the support surface 14.

The mounting bracket assembly includes a U-shaped mounting bracket 24 having a planar body section 26 and a pair of downwardly-extending support arms 28 opposed across body section 26. Each support arm 28 includes a first aperture 30 and a second aperture 32 located upwardly and rearwardly from the corresponding first aperture 30. The mounting bracket assembly 12 further includes a bearing disk 34 fixedly attached to the body section 26 of the mounting bracket 24. The mounting bracket assembly 12 further includes a U-shaped receiver 36 adapted to slidably receive within a track 37 that is fixedly attached to a bottom surface of the support surface 14. The receiver 36 rotatably receives the bearing disk 34 within a pair of oppositely disposed slots 38, thereby allowing the mounting bracket 24 to be pivoted with respect to the support surface 14.

The platform assembly 16 includes a first section 40 having a forward portion 42 and a rearward portion 44 generally opposite the forward portion 42, and a second section 46 having a forward portion 48 and a rearward portion 50 disposed generally opposite the forward portion 48 and pivotally coupled to the forward portion 42 of the first section 40 at a first point 52 as defined by a longitudinal axis of a pivot shaft 54. The first section 40 of the platform assembly 16 is U-shaped and includes a body section 56 and a pair of downwardly-extending support arms 58 generally opposed across the body section 56. Each support arm 58 includes a first aperture 60 located proximate the forward portion 42 thereof, a second aperture 62 located proximate the rearward portion 44, and a third aperture 64 located rearwardly and upwardly from the second aperture 62 and extending through a rearwardly-extending tab 66. The second section 46 includes a planar body section 68 that mateably receives and supports a keyboard cradle 70. The rearward portion 50 of the second section 46 includes a narrowed neck portion 71 having a pair of upwardly-extending support arms 72 opposed thereacross. Each support arm 72 includes an aperture 73 extending therethrough. The neck portion 71 further includes a forwardly-extending C-shaped notch 74 defined in part by a pair of sidewalls 76.

The support arm 18 is provided with a general U-shape and includes a forward portion 75, a rearward portion 77, a body section 78 and a pair of downwardly-extending arms 80 opposed across body section 78. Each arm 80 is provided with a first aperture 82 located proximate forward portion 75, a second aperture 84 located proximate rearward portion 77, and an arcuately-shaped slot 86 located proximate rearward portion 77 and below aperture 84.

In assembly, a pivot shaft 88 is received within the apertures 32 of the mounting bracket 24 and the apertures 84 of the support arm 18, thereby pivotally connecting the rearward portion 77 of the support arm 18 to the mounting bracket 24 at a point 90 as defined by a longitudinal axis of the pivot shaft 88. A pivot shaft 92 extends through the apertures 30 of the mounting bracket 24 and the slots 86 of the support arm 18, thereby operably coupling the rearward portion 77 of the support arm 18 to the mounting bracket 24 at a point 94 as defined by a longitudinal axis of the pivot shaft 92. A pivot shaft 96 extends through the apertures 82 of the support arm 18 and the apertures 64 of the first section 40 of the platform assembly 16, thereby pivotally coupling the rearward portion 44 of the first section 40 with the forward portion 75 of the support arm 18 at a point 98 as defined by a longitudinal axis of the pivot shaft 96. The pivot shaft 54 is received within the apertures 60 of the first section 40 of the platform assembly 16 and the apertures 73 of the second section 46, thereby pivotally coupling the rearward portion 50 of the second section 46 with the forward portion 42 of the first section 40 at the point 52. A pivot pin 146 is received within the apertures 62 of the first section 40 of the platform assembly 16 and the aperture 144 of the wedge arm 134, thereby pivotally coupling the second end 142 of the wedge arm 134 and the rearward portion 44 of the first section 40 at a point 148 as defined by a longitudinal axis of the pivot pin 146.

The height adjustment locking mechanism 20 (FIGS. 1 and 2) includes a center arm 100 having a first end 102 having a slot 104 that slidably receives the shaft 92 therethrough, and a second end 106 having an aperture 108 that pivotally receives the shaft 96 therethrough. In the illustrated example, the center arm 100 is substantially planar having a pair of opposing locking surfaces 110. The locking mechanism also includes a plurality of machine washers 112 each having an aperture 114 receiving the shaft 92, and a plurality of elongated locking plates 116 inner spaced with the machine washers 112 and each having an elongated slot 118 that slidably receives the shaft 92 therethrough and a plurality of apertures 120 located at an end thereof. The locking plates 116 are fixedly connected to the center arm 100 by a locking pin 122 that extends through the apertures 120 of the locking plates 116 and an aperture 124 extending through the center arm 100, such that the slots 118 are aligned with the slot 104 of the center arm 100. Although in the illustrated example the number of washers 112 and locking plates 116 are equally distributed across the center arm 210, it should be noted that other arrangements suitably for creating a frictional lock between the washers 112, the locking plates 116 and the center arm 110 may be substituted herefore.

The locking mechanism 20 further includes a wedge member 126 having an aperture 128 extending therethrough and slidably receiving the shaft 92 therethrough. The wedge member 126 also includes an angularly-disposed wedge surface 130 and an abutment surface 132 located opposite the wedge surface 130. The locking mechanism 20 further includes a wedge arm 134 having a first end 136 having an elongated slot 138 that slidably receives the shaft 92 therein and an angularly disposed wedge surface 140, and a second end 142 having an aperture 144 extending therethrough and receiving the pivot pin 146 therein. A coil spring 145 extends between the pins 92, 146 keeping the wedge arm 134 in a locked or engaged position as discussed below. It should be noted that this configuration results in a greater frictional force being developed between the washers 112, the locking plates 116, and the center arm 110 as the load being exerted on the platform assembly 16 increases.

Figure 3:
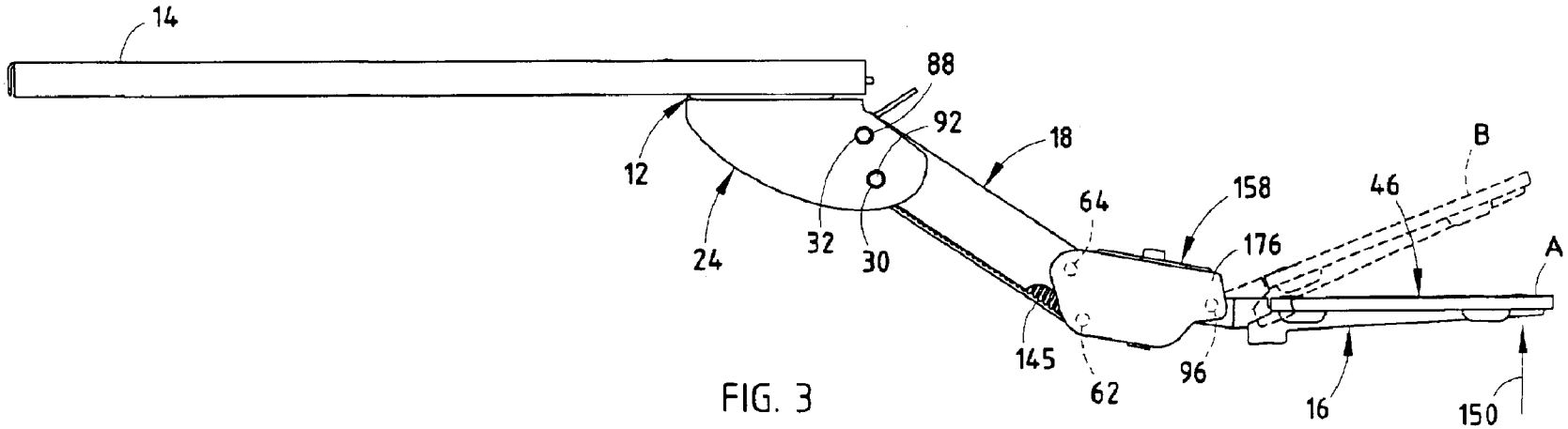
FIG. 3 is a side elevational view of the keyboard support, wherein a support surface is shown in an in-use position in solid line, and an adjustment or release position is in dotted line.

In operation and as best illustrated in FIG. 3, an upwardly-directed force 150 exerted on the platform assembly 16 causes the platform assembly 16 to pivot about the shaft 96 with respect to the support arm 18 between an in-use position A and an adjustment or release position B. The pivoting movement of the platform assembly 16 causes the shaft 146 to slide rearwardly from shaft 92, thereby increasing the distance therebetween. The increase in distance between the shaft 146 and the shaft 92 causes the first end 136 of the wedge arm 134 to slide forward with respect to the shaft 92, thereby causing the wedge surface 140 of the wedge arm 134 to disengage and reduce the force being exerted on the corresponding and mating wedge surface 130 of the wedge member 126. This reduction in force being exerted on the wedge member 126 allows the wedge member 126 to slide along the shaft 92 in a direction away from the washers 112 and locking plates 126, thereby reducing the force being exerted between the abutment surface 132 and the outermost washer 152 and reducing the frictional engagement between the stacked washers 112, the locking plates 116 and the center arm 100. The reduction of the frictional engagement between the washers 112, the locking plates 116 and the center arm 100 allows the center arm 100 to slide with respect to the shaft 92, whereas the center arm 100 is normally held in position by the frictional engagement between the locking surfaces 110 of the center arm 100 and the plurality of washers 112 and locking plates 116 when in a normal at rest position and the force 150 is not being applied. The height of the platform assembly 116 with respect to the support surface 14 may then be easily adjusted to a determined height, where the force 150 is removed and the spring 145 biases the shaft 146 towards the shaft 92, thereby forcing the wedge arm 134 to slide rearwardly, the wedge surface 140 of the wedge arm 134 to engage the wedge surface 130 of the wedge member 126, the abutment surface 132 of the wedge member 126 to apply a force to a plurality of washers 112 and the locking plates 116, which in turn frictionally abut the locking surfaces 110 of the center arm 100 and frictionally lock the same from sliding movement with respect to the shaft 92. It should be noted that while the illustrated example includes a plurality of eight washers 112, and a plurality of six locking plates, the magnitude of the frictional force exerted across the plurality of the washers 112 and the locking plates 116 and ultimately exerted on the center arm 110 may be increased by increasing the number of the washers 112 and the locking plates 116. It should be noted that the biasing force exerted by the spring 145 on the shaft 146 prevents accidental loss of support of the platform assembly 16, as may be caused by an operator exerting a downwardly-directed force on the platform assembly 16 forward of the pivot point 98.

A lift-assist coil spring 154 is slidably received on the shaft 88 and includes a pair of engagement legs 156 located at opposite ends thereof and configured to abut the body section 26 of the mounting bracket 24 and the body section 78 of the support arm 18. The spring 154 is provided to assist the operator in positioning the platform assembly 16 to the selected height.

The tilt adjustment mechanism 22 includes an actuator member 158 having an enlarged, easily graspable head portion 160 and an elongated shaft 162 having a threaded first portion 164 and a narrowed second portion 166. The tilt adjustment mechanism 22 also includes a linking member 168 having a pair of opposing elongated slots 170 that receive the side walls 76 of the second portion 46 of the platform assembly 16 therein, and a centrally-located threaded aperture 172.

In assembly, the head portion 160 of the actuator member 158 is recessively received within an aperture 174 of a cover member 176 housing the first section 40 of the platform assembly 16. The shaft 162 of the actuator member 158 extends downwardly through an aperture 178 located within the body section 56 of the first section 40 of the platform assembly 16. The first portion 164 of the shaft 160 is threadably received within the aperture 172 of the linking member 168, while the second portion 166 of the shaft 162 extends downwardly through an aperture 180 located within a bottom cover plate 182 and is secured there below via bolt 184 that is threadably received within an end of the second portion 166 of the shaft 162.

In operation, the angular position of the second portion 46 of the platform assembly 16 is adjusted relative to the support surface 14 by turning the head portion 160 of the actuator member 158, thereby causing the linking member 168 to move along the length of the shaft 162 and the second section 46 of the platform assembly 162 to pivot about the shaft 54.

The present inventive adjustable keyboard support mechanism provides an uncomplicated design, can be easily and quickly adjusted by the end user is efficient in its use, economical to manufacture, capable of a long operating life, and is particularly well adapted for the proposed use.

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. An adjustable keyboard support mechanism, comprising:

a mounting bracket adapted for attachment to a support surface;

a platform having a forward portion and a rearward portion thereof disposed generally opposite the forward portion;

a support arm having a first end thereof pivotally coupled with the mounting bracket at a first point and slidably coupled with the mounting bracket at a second point, and a second end pivotally coupled with the platform at a third point; and a locking mechanism, comprising:

a center arm having a first end slidably coupled to the mounting bracket at the second point, and pivotally coupled with the platform at the third point, such that an upwardly directed force exerted on the platform allows the center arm to slide with respect to the second point;

at least two planar frictional members sandwiching and frictionally engaging the center arm, such that the sliding movement of the center arm with respect to the second point is restricted, a wedge member having an angled surface, and an abutment surface opposite the angled surface of the wedge member and adapted to abut one of the frictional members; and a wedge arm having a first end pivotally coupled to the platform at a fourth point, and a second end slidably coupled to the mounting bracket at the second point such that the upwardly directed force exerted on the platform causes the wedge arm to slide with respect to the second point, the second end of the wedge arm having an angled surface adapted to abut the angled surface of the wedge member such that sliding of the wedge arm due to the upwardly directed force exerted on the platform reduces a force exerted on the wedge member by the wedge arm and reduces the frictional engagement between the frictional members and the center arm, thereby allowing the center arm to slide with respect to the second point and the height of the platform to be adjusted relative to the support surface.

2. The adjustable keyboard support mechanism of claim 1, wherein the at least two planar frictional members include a plurality of interspaced washers and plate members, wherein the plate members are operably coupled to the center arm and are slidable with respect to the second point.

3. The adjustable keyboard support mechanism of claim 2, wherein the plurality of the washers and the plate members include at least six washers and at least six plate members equally distributed on opposite sides of the center arm.

4. The adjustable keyboard support mechanism of claim 3, wherein the locking mechanism further includes:

a spring member resiliently biasing the second point towards the fourth point.

5. The adjustable keyboard support mechanism of claim 4, wherein the spring member includes a coil spring.

6. The adjustable keyboard support mechanism of claim 5, further including:

a lift assist mechanism operably coupled to the mounting bracket and the support arm and adapted to assist an operator in applying the upwardly directed force to the platform.

7. The adjustable keyboard support mechanism of claim 1, wherein the at least two planar frictional members include a plurality of interspaced washers and plate members substantially equally distributed on opposite sides of the center arm.

8. The adjustable keyboard support mechanism of claim 1, wherein the locking mechanism further includes:

a spring member resiliently biasing the second point towards the fourth point.

9. The adjustable keyboard support mechanism of claim 8, wherein the spring member includes a coil spring.

10. The adjustable keyboard support mechanism of claim 1, further including:

a lift assist mechanism operably coupled to the mounting bracket and the support arm and adapted to assist an operator in applying the upwardly directed force to the platform.

11. An adjustable keyboard support mechanism, comprising:

a mounting bracket adapted for attachment to a support surface;

a platform having a first section having a forward portion and a rearward portion disposed generally opposite the forward portion, and a second section having a forward portion and a rearward portion disposed generally opposite the forward portion of the second section and pivotably coupled to the forward portion of the first section at a first point; and a support arm having a first end thereof pivotally coupled with the mounting bracket at a second point and slidably coupled with the mounting bracket at a third point, and a second end pivotally coupled with the platform at a fourth point;

a locking mechanism, comprising:

a center arm having a first end slidably coupled to the mounting bracket at the third point, and pivotally coupled with the platform at the fourth point, such that an upwardly directed force exerted on the platform allows the center arm to slide with respect to the third point;

at least two planar frictional members sandwiching and frictionally engaging the center arm, such that the sliding movement of the center arm with respect to the third point is restricted;

a wedge member having an angled surface, and an abutment surface opposite the angled surface of the wedge member and adapted to abut one of the frictional members; and a wedge arm having a first end pivotally coupled to the platform at a fifth point, and a second end slidably coupled to the mounting bracket at the third point such that the upwardly directed force exerted on the platform causes the wedge arm to slide with respect to the third point, the second end of the wedge arm having an angled surface adapted to abut the angled surface of the wedge member such that sliding of the wedge arm due to the upwardly directed force exerted on the platform reduces a force exerted on the wedge member by the wedge arm and reduces the frictional engagement between the frictional members and the center arm, thereby allowing the center arm to slide with respect to the third point and the height of the platform to be adjusted relative to the support surface; and a tilt adjustment mechanism having an actuator member defining a length and operably coupled with the first section of the platform, and a linking member operably coupled to the rearward portion of the second section of the platform at a sixth point and adjustable along the length of the actuator member such that an adjustment of the linking member along the length of the actuator member causes the second of the platform to pivot about the first point, thereby adjusting a tilt of the second section of the platform relative to the support surface.

12. An adjustable keyboard support mechanism, comprising:

a mounting bracket adapted for attachment to a support surface;

a support arm having a first end thereof pivotably coupled with the mounting bracket, and a second end;

a platform having a first section having a forward portion and a rearward portion disposed generally opposite the forward portion and operably coupled to the second end of the support arm, and a second section having a forward portion and a rearward portion disposed generally opposite the forward portion of the second section and pivotably coupled to the forward portion of the first section at a first point; and an adjustment mechanism having an actuator member defining a length and operably coupled with the first section of the platform, and a linking member operably coupled to the rearward portion of the second section of the platform at a second point and adjustable along the length of the actuator member such that an adjustment of the linking member along the length of the actuator member causes the platform to pivot about the first point, thereby adjusting a tilt of the second section of the platform relative to the support surface;

wherein the forward portion of the second section includes a pair of opposing flanges defining the second point, and wherein the linking member includes a pair of grooves on opposite sides thereof that slidably receive the flanges therein.

13. The adjustable keyboard support mechanism of claim 12, wherein the actuator includes a threaded shaft, and wherein the linking member is threadably coupled to the threaded shaft and adjustable along the length.

14. The adjustable keyboard support mechanism of claim 13, wherein the actuator includes a graspable head outwardly disposed from the platform.

15. The adjustable keyboard support mechanism of claim 14, further including:

a cover member housing at least a portion of the first section of the platform.

16. An adjustable keyboard support mechanism, comprising:

a mounting bracket adapted for attachment to a support surface; a support arm having a first end thereof pivotably coupled with the mounting bracket, and a second end;

a platform having a first section having a forward portion and a rearward portion disposed generally opposite the forward portion and operably coupled to the second end of the support arm, and a second section having a forward portion and a rearward portion disposed generally opposite the forward portion of the second section and pivotably coupled to the forward portion of the first section at a first point; and an adjustment mechanism having an actuator member defining a length and operably coupled with the first section of the platform, and a linking member operably coupled to the rearward portion of the second section of the platform at a second point and adjustable along the length of the actuator member such that an adjustment of the linking member along the length of the actuator member causes the platform to pivot about the first point, thereby adjusting a tilt of the second section of the platform relative to the support surface; and wherein the actuator includes a threaded shaft, and wherein the linking member is threadably coupled to the threaded shaft and adjustable along the length.

17. The adjustable keyboard support mechanism of claim 16, further including:

a cover member housing at least a portion of the first section of the platform.

* * * * *

UNITED STATES PATENT AND TRADEMARK OFFICE

CERTIFICATE OF CORRECTION

PATENT NO. : 6,929,228 B2
DATED : August 16, 2005
INVENTOR(S) : Whitaker et al.

It is certified that error appears in the above-identified patent and that said Letters Patent is hereby corrected as shown below:

Column 1,
Line 10, “date” should be -- data --.

Column 2,
Line 44, delete “a”.

Column 3,
Line 24, delete “bottom”.
Line 50, “to” should be -- for --.

Column 5,
Line 25, “arm 210” should read -- arm 110 --.
Line 25, “suitably” should read -- suitable --.

Column 6,
Line 56, “there below” should be -- therebelow --.

Column 7,
Line 1, after “user” insert -- , --.

Column 9,
Line 14, after “second” insert -- section --.
Line 42, “forward” should be -- rearward --.

Signed and Sealed this

Twenty-eighth Day of February, 2006

JON W. DUDAS
*Director of the United States Patent and Trademark Office*